United States Patent [19]

Steddum et al.

[11] 4,193,455

[45] Mar. 18, 1980

[54] SPLIT STACK BLOWOUT PREVENTION SYSTEM

[75] Inventors: Riddle E. Steddum; Donald R. Ray; Bruce L. Crager, all of Houston, Tex.

[73] Assignee: Chevron Research Company, San Francisco, Calif.

[21] Appl. No.: 896,264

[22] Filed: Apr. 14, 1978

[51] Int. Cl.[2] ..... E21B 7/12

[52] U.S. Cl. ..... 166/359; 166/55; 405/211

[58] Field of Search ..... 166/363, 364, 367, 362, 166/366, 338, 339, 358, 359, 55, 72, 75 R; 175/7, 8, 9; 405/211, 217

[56] References Cited

U.S. PATENT DOCUMENTS

| | | | |
|---|---|---|---|
| 3,179,179 | 4/1965 | Kofahl | 166/363 |
| 3,189,098 | 6/1965 | Haeber | 166/367 X |
| 3,195,639 | 7/1965 | Pollard et al. | 175/7 X |
| 3,324,943 | 6/1967 | Price | 175/7 X |
| 3,461,957 | 8/1969 | West | 166/351 |
| 3,561,526 | 2/1971 | Williams, Jr. et al. | 166/55 |
| 3,592,263 | 7/1971 | Nelson | 166/351 |
| 3,793,840 | 2/1974 | Mott et al. | 405/211 |
| 3,866,676 | 2/1975 | Burns | 166/363 |
| 3,871,184 | 3/1975 | Schirtzinger | 175/9 |
| 4,046,191 | 9/1977 | Neath | 166/75 R |
| 4,080,797 | 3/1978 | Thompson | 405/217 |

*Primary Examiner*—James A. Leppink
*Assistant Examiner*—Richard E. Favreau
*Attorney, Agent, or Firm*—R. L. Freeland, Jr.; William J. Egan, III

[57] ABSTRACT

A blowout prevention system for an offshore structure positioned on the underwater bottom in a body of water which contains moving ice masses that could force the structure off location wherein a surface blowout preventer stack for conventional well control is connected to the upper end of a riser with the lower end of the riser being disconnectably connected to a subsurface blowout preventer stack which provides the necessary well control should the structure be forced off location. The subsurface stack is positioned on a wellhead located in a chamber in the subsea bottom and is disconnectably connected to the riser so that the riser may be quickly removed from the subsea bottom should the structure be forced off location.

3 Claims, 3 Drawing Figures

SPLIT STACK BLOWOUT PREVENTION SYSTEM

FIELD OF THE INVENTION

The present invention relates to blowout prevention systems for offshore structures and, more particularly, to a blowout prevention system for use with a bottom-supported offsore structure which is to be located in arctic and other ice-infested waters wherein an impinging ice mass could force the structure off location.

BACKGROUND OF THE INVENTION

In recent years, offshore exploration and production of petroleum products has been extended into arctic and other ice-infested waters in such locations as northern Alaska and Canada. These waters are generally covered with vast areas of sheet ice 9 months or more out of the year. Sheet ice may reach a thickness of 5 to 10 feet or more, and may have a compressive or crushing strength in the range of about 200 to 1000 pounds per square inch. A still more severe problem encountered in arctic waters is the presence of larger masses of ice such as pressure ridges, rafted ice or floebergs. Larger ice masses may have a thickness of up to 50 feet such that they move along the subsea bottom and produce scour marks in the bottom of up to several feet deep. Sheet ice and larger ice masses impose very high forces on any stationary structures in their paths; thus, it is very possible that an offshore structure may be forced off location by an impinging ice mass.

The possibility that a bottom-supported structure might be forced off a well site does present some unusual problems with respect to the structure's blowout prevention system. On bottom-supported structures, a surface blowout preventer (BOP) stack is used to provide the necessary well control for sealing the well when an abnormal well pressure develops, and generally, the surface BOP stack is located just below the drill floor of the structure. As discussed above, if very large ice forces are imposed on the structure, there exists a possibility that the structure will be forced off location. If this should occur, the wellhead would be damaged and the surface BOP stack would be disconnected from the wellhead which would prevent any sort of well control.

It has been proposed heretofore that a conventional surface BOP stack be utilized with mudline casing suspension equipment, which is used routinely on jack-up rig operations. The casing suspension equipment is installed at a wellhead in a chamber in the subsea bottom to permit removal of the riser from the subsea bottom should the structure be forced off location, and in such an event, the wellhead is protected from damage by being located in the chamber. The suspension equipment may include a casing bridge plug, a hanger-safety valve assembly, both of which must be run to the wellhead when the structure is being forced off location, or a hydraulically operated ball valve located between the wellhead and the riser connector.

The system discussed above, however, is inadequate for at least two reasons. First, it takes too long to remove the riser. Second, no BOP equipment for well control is provided should the structure be forced off location. Accordingly, the present invention is directed to a blowout prevention system which is capable of very quick removal of the riser from the underwater bottom and which provides adequate BOP protection.

SUMMARY OF THE INVENTION

Broadly speaking, the present invention comprises a blowout prevention system for use with an offshore structure positioned on the subsea bottom above a well site in a body of water that may contain moving ice masses that could force the structure off location. The blowout prevention system of this invention includes a subsurface blowout preventer stack having shear rams for sealing the well. The subsurface stack is connected to a wellhead located in a chamber in the subsea bottom. The chamber is deep enough to prevent any ice mass moving along the subsea bottom from damaging any equipment, such as the subsurface stack, located therein. Appropriate means disconnectably connect a riser, which extends from the offshore structure to the subsea bottom, into the subsurface stack. A surface blowout preventer stack is connected to the riser for well control. Appropriate means are provided for raising the riser from the subsea bottom and into the structure.

Control means located in the structure selectively operate the shear rams of the subsurface stack and the means for disconnectably connecting the riser from the subsurface stack. Kill and choke means are also provided to control the release of fluids from the well and to pump fluids into the well, respectively. The kill and choke means are arranged to be in communication with the well even after the rams of the subsurface stack have closed.

PRINCIPAL OBJECT OF THE INVENTION

The particular object of the present invention is to provide a well control system for an offshore structure which might be forced off location wherein a riser is disconnectably connected to a subsurface blowout preventer stack located in a chamber in the subsea bottom so that the riser may be quickly disconnected from the subsurface stack and raised into the structure.

Additional objects and advantages of the invention will become apparent from a detailed reading of the specification and drawings which are incorporated herein and made a part of this specification.

DESCRIPTION OF THE PREFERRED EMBODIMENT

Figure 1:
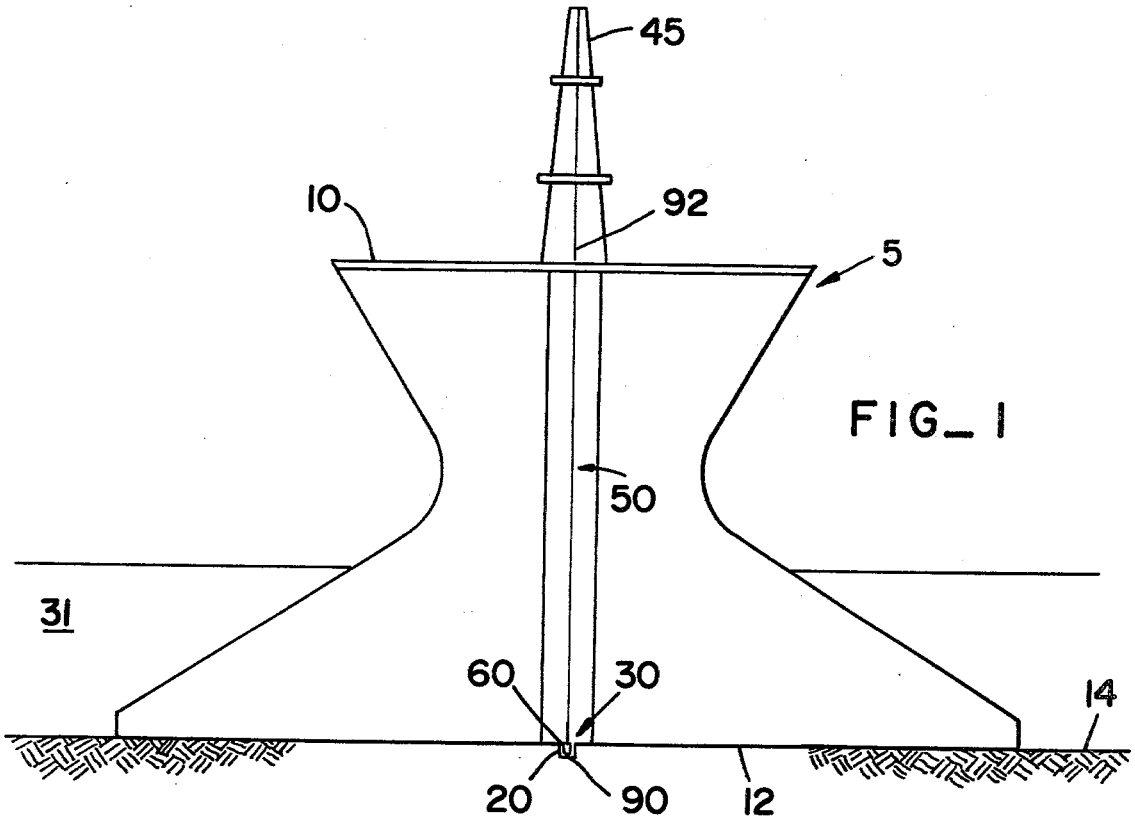
FIG. 1 is an overall schematic elevation view illustrating the apparatus of the invention in operating position.

Referring now to the drawings, FIG. 1 represents a marine structure 5 located in a body of water 31 and particularly designed for installation in arctic and other ice-infested waters upon which thick sheets of ice and larger masses of ice may be formed. The structure is held in place on the underwater bottom 14 by its own weight plus the weight of any ballast added to the structure. To assist in holding the structure in place against the horizontal and vertical forces imposed thereon by an impinging ice mass, structural skirt members, not shown, may be arranged on the bottom 12 of the structure. The structural skirt members impart additional shear resistance between the bottom of the structure and the subsea bottom to prevent movement of soil from underneath the structure, thereby helping to maintain the structure in a relatively fixed position on the subsea bottom.

A work platform 10 of structure 5 is illustrated in FIG. 1 with a drilling rig 45 located thereon along with other conventional drilling equipment, not shown, for use in drilling a well bore 90 within the subsurface. A moonpool or drillway 50 thus extends from deck 10 down through the structure to water bottom 14 so that a drill string 92 may be extended into well bore 90.

Figure 2A:
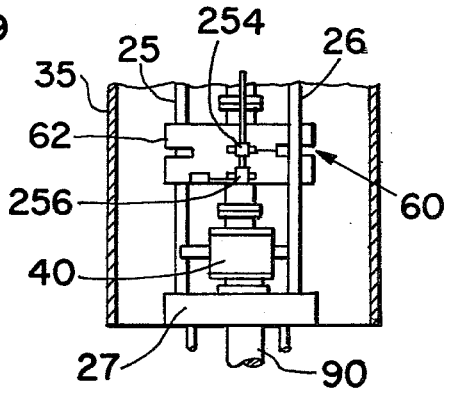
FIG. 2A is a schematic view illustrating the opposite side of the subsurface blowout preventer stack shown in FIG. 2.
Figure 2:
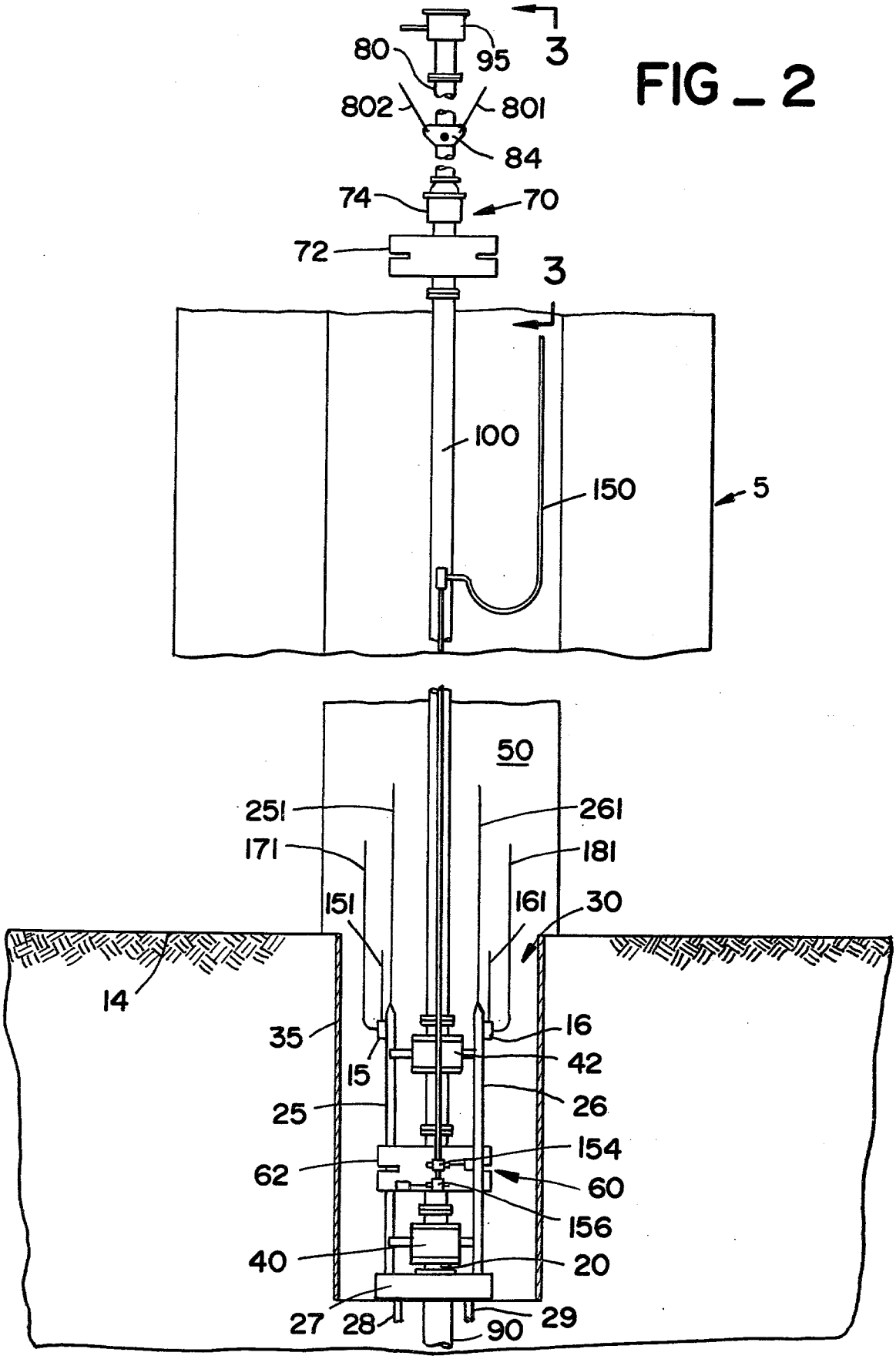
FIG. 2 is an enlarged schematic view of portions of FIG. 1.

As illustrated in FIGS. 1 and 2, a wellhead 20 is located in a cellar or chamber, indicated generally by reference numeral 30, in the subsea bottom 14 in which the hole is being drilled. The chamber is excavated to a sufficient depth below the mudline to prevent ice masses moving along the subsea bottom in the vicinity of the well from damaging the subsurface equipment located in the chamber. Large ice masses moving along the subsea bottom may produce scour marks several feet deep; therefore, the clearance between the top of the equipment located in the chamber and the subsea bottom should be greater than the maximum ice scour predicted for the particular area. A caisson 35 may also be installed in the excavated chamber to prevent the walls of the chamber from collapsing.

A subsurface blowout preventer (BOP) stack 60 is located in the chamber and is releasably connected at its lower end to wellhead 20 by hydraulic connector 40 or other appropriate means. The subsurface BOP stack 60 provides the necessary well control in emergency situations when the structure is forced off location by an impinging ice mass. Since BOP stack 60 is designed only for emergency use, it only needs to have a limited capacity and is thus much smaller, simpler and less costly than most subsurface stacks used with floating structures. The subsurface stack 60 may include a double ram preventer 62, although it would be possible to use a single pair of shear rams instead of the two pairs of shear rams shown. If emergency abandonment of the well becomes necessary and if the drill pipe still passes through the subsurface stack, the shear rams may be closed to cut the drill pipe and seal the well. If no pipe is in the well, the shear rams may be closed to provide a high-pressure seal on the open well.

The size and complexity of subsurface stack 60 is kept to a minimum by the fact that a surface BOP stack, indicated generally by 70, is provided for conventional well control operations, that is, where the structure has not been forced off location by an impinging ice mass. The surface BOP stack is of the type generally used on bottom-supported structures and may include a spherical BOP 74 connected at its lower end to a double pipe ram BOP 72. Of course, other possible BOP arrangements for the surface stack are possible.

As discussed hereinabove, hydraulic connector 40 is releasably connected to wellhead 20. A second hydraulic connector 42, or other approriate means, is disconnectably connected at its lower end to the upper end of subsurface stack 60. The upper end of connector 42 is connected to riser 100, which extends from structure 5 into chamber 30, so that the riser may be connected into or disconnected from the subsurface stack. If the structure is being forced off location, hydraulic connector 42 may be operated by appropriate control means, not shown, in the structure to disconnect the riser 100 from subsurface stack 60. The control means at the surface is in communication with the subsea equipment, hydraulic connectors 40 and 42 and subsurface stack 60, through hydraulic control lines 171 and 181 which are respectively connected to subsea control pods 15 and 16. The control means selectively operates the subsea equipment through either control pod 15 or 16; thus, the equipment in the chamber may still be operated if one control pod fails. The control system is also designed so that control pods 15 and 16 may be retrieved by means of lines 151 and 161, respectively, permitting one of the pods to be inspected and serviced while the subsurface equipment and the second pod remain in position for operation. To permit removal of the control pods, male connectors on the control pods mate with female connectors mounted on guide posts 25 and 26.

At least two guide posts 25 and 26 extend vertically from spaced-apart points on guide base 27, which is supported on the bottom of the chamber by at least two supports 28 and 29. Guidelines 251 and 261 extending from guideposts 25 and 26, respectively, into the structure are used to guide the subsea equipment as it is lowered from the structure and positioned on wellhead 20. For initial installation, it is expected that the subsurface stack 60 and hydraulic connectors 40 and 42 will be made up at the surface and run on guidelines 251 and 261 to the subsea bottom where connector 40 will be connected to wellhead 20.

A pair of kill valves, 154 and 156, and pair of choke valves, 254 and 256, see FIG. 2A, are also provided at the subsea bottom to control the flow of fluids into the well and to control the flow of fluids out of the well, respectively. The kill and choke valves are positioned on the subsurface stack 60 below the two pairs of shear rams so that they are in communication with the well even after the rams have been closed. This is advantageous because it facilitates the re-establishment of communication with the well should the structure subsequently be positioned on the same well site after having been forced off. Kill and choke lines, indicated generally by 150, which may be attached to riser 100, extend from the structure and connect the kill and choke valves to a kill and choke manifold located on the structure.

Figure 3:
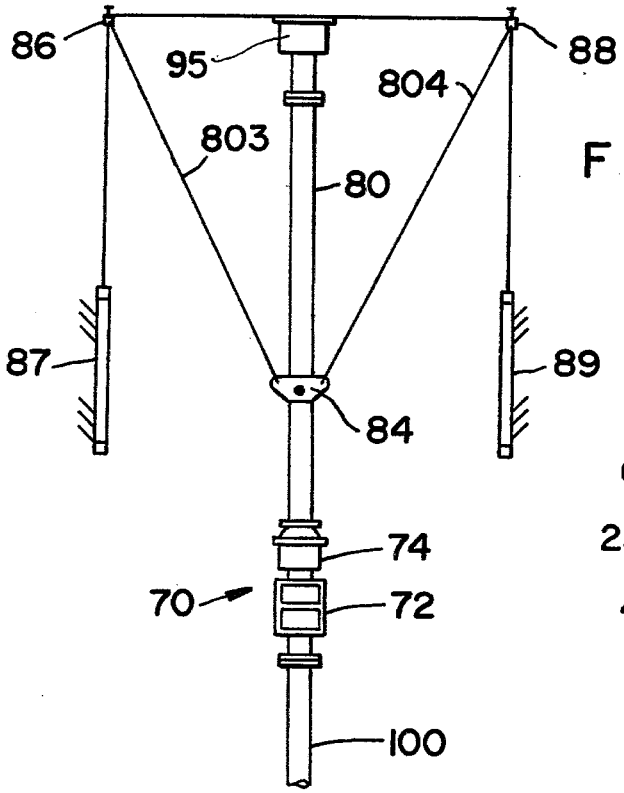
FIG. 3 is an elevation schematic view of the upper end of the riser and its connection to the surface blowout preventer stack, the telescopic joint and the riser retrieval system taken along line 3—3 of FIG. 2.

As discussed above, riser 100 extends from the structure 5 into chamber 30 where it is disconnectably connected to subsurface stack 60 by connector 42 so that it may be disconnected from subsurface stack 60 and raised into the structure when the structure is forced off location. To permit vertical movement of the riser so that the riser may be raised into the structure, a telescopic joint 80 is connected to the riser. If, instead of a telescopic joint, a length of pipe were extended between the surface stack 70 and the diverter 95, it would be necessary to unbolt the pipe before the riser could be raised. This, of course, would increase the time for removing the riser from the subsea bottom. As illustrated in FIGS. 2 and 3, telescopic joint 80 is connected to the upper end of the surface BOP stack 70; however, it would also be possible to connect the telescopic joint at the lower end of the surface stack. If the telescopic joint was connected to the lower end of the surface stack, it would of course have to be constructed so that its capacity for withstanding a blowout is at least that of the surface stack.

To raise the riser 100 out of chamber 30 and into structure 5, a retrieval system is provided. Two pairs of retrieval lines 801 and 802, shown in FIG. 2, and 803 and 804, shown in FIG. 3, are connected to the lower end of telescopic joint 80 at collar 84. The retrieval lines extend upwardly and then over pulleys to be connected to hydraulic cylinders mounted on the walls of the moonpool 50. The cylinders provide the necessary lifting force to raise the riser and surface stack so that the riser is removed from chamber 30. FIG. 3 illustrates retrieval lines 803 and 804 extending upwardly, over pulleys 86 and 88, respectively, to hydraulic cylinders 87 and 89, respectively. The arrangement of retrieval lines 801 and 802, which is not shown, is the same as that discussed above with each line running over a respective pulley to a respective hydraulic cylinder.

Should structure 5 be forced off location by an impinging ice mass, the shear rams of the subsurface stack 60 will be closed. The choke valves, not shown, and the kill valves 154 and 156 will also be closed. The riser 100 will be disconnected from the subsurface stack 60 by disengaging hydraulic connector 42. The hydraulic cylinders of the retrieval system, 87, 89 and the two cylinders not shown, will be activated so that the riser, connector 42 and surface stack 70 are raised, telescopic joint 80 permitting vertical movement thereof, a sufficient distance so that riser 100 is raised from chamber 30 and placed in the lower moonpool area of the structure. If drill pipe is extended through the riser, it may be raised with the riser by closing the pipe rams and spherical BOP in the surface BOP stack. As the structure moves off location, the guidelines and control lines will be sheared. The choke and kill lines, which are releasably connected by a stab connector to the choke and kill valves, will be disconnected and raised with the riser into the lower moonpool area. After the rams in the subsurface stack are closed, it is estimated that the riser can be disconnected from the subsurface stack and retracted into the lower moonpool area in approximately 30 seconds.

SUMMARY OF THE ADVANTAGES

The blowout prevention system of the present invention offers a system which provides the necessary well control should the structure be forced off location and which is capable of disconnecting the riser and retracting it from the subsea bottom in a relatively short time. With this system, normal drilling operations only involve the use of a conventional surface BOP stack and since this stack is readily available for servicing, the BOP system for the structure is much simpler and less expensive than would be the case if a full subsurface BOP stack were used. On the other hand, the minimal subsurface stack provides the necessary control for the well should the structure be forced off location by an impinging ice mass.

Although certain specific embodiments of the invention have been described herein in detail, the invention is not to be limited to only such embodiments, but rather only by the appended claims.

What is claimed is:

1. A blowout prevention system for a movable offshore structure positioned on a subsea bottom above a well site in a body of water which may contain moving ice masses that could force the structure off location, comprising:

a subsurface blowout preventer stack at the subsea bottom having double shear rams for sealing a well;

a first means at the subsea bottom for disconnectably connecting a riser to said subsurface blowout preventer stack;

a subsea wellhead;

a second means at the subsea bottom for connecting said subsurface blowout preventer stack to said subsea wellhead, said subsurface blowout preventer stack, said first and said second means and said wellhead located in a chamber in the subsea bottom having a depth substantially greater than the combined height of said subsurface blowout preventer stack and said first and said second means so that said subsurface blowout preventer stack and said first and said second means are protected from damage due to ice masses contacting the subsea bottom in the vicinity of the well site;

a riser extending from the structure down to the subsea bottom and into said chamber and disconnectably connected at its lower end by said first means to said subsurface blowout preventer stack so that said riser may be connected into and disconnected from said subsurface blowout preventer stack;

a surface blowout preventer stack connected to said riser for providing means for controlling the well, said surface blowout preventer stack including a spherical blowout preventer connected at its lower end to the upper end of a double pipe ram blowout preventer;

a telescopic joint connected to said riser to permit vertical movement of said riser;

retrieval means connected to said telescopic joint for raising said riser out of said chamber and into the structure;

control means in the structure for selectively operating the shear rams of said subsurface blowout preventer stack to seal the well and said first means to connect and disconnect said riser;

kill and choke lines extending from the structure to said subsurface blowout preventer stack;

at least one choke valve positioned below said shear rams of said subsurface blowout preventer stack so as to be in communication with the well even after said shear rams have closed, said choke valve connected to said choke line; and at least one kill valve positioned below said shear rams of said subsurface blowout preventer stack so as to be in communication with the well even after said shear rams have closed, said kill valve connected to said kill line.

2. A blowout prevention system for a movable offshore structure positioned on a subsea bottom above a well site in a body of water which may contain moving ice masses that could force the structure off location, comprising:

a subsurface blowout preventer stack at the subsea bottom having double shear rams for sealing the well;

a first hydraulic connector at the subsea bottom disconnectably connected at its lower end to the upper end of said subsurface blowout preventer stack so that a riser may be connected into and disconnected from said subsurface blowout preventer stack;

a subsea wellhead;

a second hydraulic connector at the subsea bottom connected at its upper end to said subsurface blowout preventer stack and at its lower end to said subsea wellhead; said wellhead located in a chamber having a depth substantially greater than the combined height of said subsurface blowout preventer stack and said first and said second hydraulic connectors so that said subsurface blowout preventer stack and said first and said second hydraulic connectors are located beneath the surface of the subsea bottom and are thus protected from damage due to ice masses contacting the subsea bottom in the vicinity of the well site;

a riser extending from the structure down to the subsea bottom and into said chamber and disconnectably connected at its lower end by said first hydraulic connector to said subsurface blowout preventer stack so that said riser may be connected into and disconnected from said subsurface blowout preventer stack;

a surface blowout preventer stack connected to the upper end of said riser for providing means for controlling the well, said surface blowout preventer stack including a spherical blowout preventer connected at its lower end to the upper end of a double pip ram blowout preventer;

a telescopic joint connected to the upper end of said surface blowout preventer stack, said telescopic joint permitting vertical movement of said riser;

retrieval means connected to the lower end of said telescopic joint for raising said surface blowout preventer stack, said riser and said first hydraulic connector to remove said riser out of said chamber and into the structure;

control means in the structure for selectively operating the shear rams of said subsurface blowout preventer stack to seal the well and said first means to connect and disconnect said riser;

kill and choke lines affixed to said riser extending from the structure to said subsurface blowout preventer stack;

at least one choke valve positioned on said subsurface blowout preventer stack below said pair of shear rams of said subsurface blowout preventer stack so as to be in communication with the well to control the flow of fluids out of the well even after said shear rams have closed, said choke valve connected to said choke line;

at least one kill valve positioned on said subsurface blowout preventer stack below said pair of shear rams of said subsurface blowout preventer stack in communication with the well to control the flow of fluids into the well even after said shear rams have closed, said kill valve connected to said kill line.

3. The blowout prevention system of claim 2 further including guidance means for positioning said subsurface blowout preventer stack and said first and said second hydraulic connectors on said wellhead in said chamber.

* * * * *

UNITED STATES PATENT AND TRADEMARK OFFICE

CERTIFICATE OF CORRECTION

PATENT NO. : 4,193,455

DATED : March 18, 1980

INVENTOR(S) : RIDDLE E. STEDDUM et al

It is certified that error appears in the above-identified patent and that said Letters Patent are hereby corrected as shown below:

Column 7, line 22, "pip ram" should read --pipe ram--.

" 8, line 5, "first means" should read --first hydraulic connector--.

Signed and Sealed this

Twenty-ninth Day of July 1980

[SEAL]

Attest:

SIDNEY A. DIAMOND

Attesting Officer

Commissioner of Patents and Trademarks